United States Patent [19]

Hiroshi

[11] 4,106,615

[45] Aug. 15, 1978

[54] BOX BLANK AND ASSEMBLED PACKAGE BOX FOR DISPLAY

[75] Inventor: Suzuki Hiroshi, Sagamihara, Japan

[73] Assignee: Lion Hamigaki Kabushiki Kaisha, Japan

[21] Appl. No.: 655,935

[22] Filed: Feb. 6, 1976

[30] Foreign Application Priority Data

Feb. 6, 1975 [JP] Japan ..... 50-17304[U]

[51] Int. Cl.[2] ..... B65D 25/54

[52] U.S. Cl. ..... 206/45.31; 206/624; 206/806

[58] Field of Search ..... 206/45.31, 461, 806; 229/52 B, DIG. 4, 51 TS, 51 TC, 51 SC, 51 D

[56] References Cited

U.S. PATENT DOCUMENTS

| | | | |
|---|---|---|---|
| 1,516,090 | 11/1924 | Gary et al. | 229/51 TS |
| 1,771,760 | 7/1930 | MacLellan | 229/DIG. 4 |
| 1,956,642 | 5/1934 | Einson | 206/806 X |
| 2,019,250 | 10/1935 | Collins | 206/45.31 X |
| 2,889,104 | 6/1959 | Caster et al. | 229/52 B |
| 2,979,192 | 4/1961 | Blonder | 206/806 X |
| 3,032,242 | 5/1962 | Roberts | 206/806 X |
| 3,659,704 | 5/1972 | Collura et al. | 206/806 X |
| 3,815,809 | 6/1974 | Walters | 229/52 B X |

FOREIGN PATENT DOCUMENTS

| | | | |
|---|---|---|---|
| 951,232 | 3/1964 | United Kingdom | 206/806 |
| 604,517 | 7/1948 | United Kingdom | 206/45.31 |

*Primary Examiner*—Stephen Marcus

*Attorney, Agent, or Firm*—Blum, Moscovitz, Friedman & Kaplan

[57] ABSTRACT

This invention relates to box blanks and to assembled package boxes for the display of small commodities such as tooth brushes and razor blades, the boxes having hanger portions so that they can be conveniently suspended for display.

18 Claims, 15 Drawing Figures

BOX BLANK AND ASSEMBLED PACKAGE BOX FOR DISPLAY

BACKGROUND OF THE INVENTION

While such small commodities as tooth brushes are often sold loose by putting them in pouches, it is usual to package such articles in boxes made of plastics or paper for the purpose of promoting the sale of these articles by conveniently displaying them in the shop or store or from the standpoints of convenience of handling or of sanitation.

Plastic cases or boxes permit articles contained in them to be seen well-displayed if the box packages are transparent and suitably arranged in the store, thus aiding in bettering the sale, and they may also be conveniently handled and readily manufactured on a mass production scale. On the demerit side, however, they are too expensive to be discarded after the contents are consumed, and this high cost gives rise to various problems in the economy of resources. Moreover, such boxes are space-consuming and expensive to ship if shipped before filling with goods.

While paper boxes have been used before the spread of plastic cases, and are greatly advantageous in view of economy, they are usually rectangular in shape and hence must be stacked up for display in the store since they do not incorporate means for support on a display rack or the like, so that they are very inferior to the plastic cases in respect of the sale promotion effect. Provision of the paper box with a suspension tongue of a separate material to the end of bettering the display effect, on the other hand, poses difficulty in automatic mass production by machines. Also, it results in much waste paper at the time of manufacture and is inadequate in strength. Consequently a box design which can be made from a box blank by automatic machinery and which provides for support for the box is a desirable objective.

SUMMARY OF THE INVENTION

A box blank can be scored and cut or punched from sheet stock such as cardboard or transparent plastic sheet or film. The blank has panels which on assembly become front, back and sides of a package box, and more specifically, of the box portion of said package box. The blank also has elements which form a top and a bottom of said box portion, and, importantly, a support member which extends above the box portion of said package box, said support member being a panel which is perforated or notched or otherwise shaped to receive a hook or rod or the like for supporting said package box and its contents for display.

In a preferred embodiment, the support member is strengthened by the joining of at least two layers of said sheet to form said support member, said layers preferably being bonded together as with an adhesive or cement.

Embodiments are presented in which one or more segments of said blank project inwardly of the assembled box portion to cooperate in holding the contents of said box portion in a desired position. One or more windows may be provided in the front and side panels of said box portion so that the contents thereof may be viewed as an inducement to purchase.

An object of the invention is to present an assembled package box having a hanger portion for support purposes, and which can positively preclude the prior art drawbacks as mentioned hereinabove, is very suited to machine processing in manufacture and permits great improvement in the productivity both in manufacture and packing operation.

Another object of the invention is to provide an assembled package box having a hanger portion for support thereof, which can be automatically manufactured and the hanger portion of which can be rationally reinforced without giving rise to obstruction in display and without possibility of adversely affecting the packed small commodity.

A further object of the invention is to provide an assembled package box, which enables the saving of its material and other packing materials.

An important object of the present invention is a box blank which can be automatically assembled into a display package including a support portion which facilitates hanging the package from a hook or display rack.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
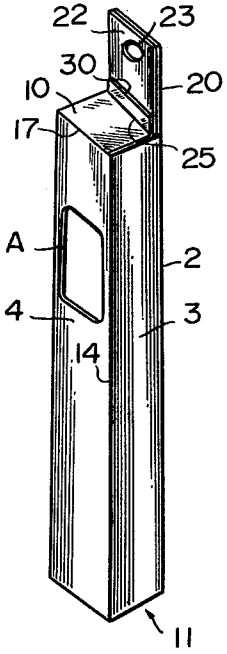
FIG. 2 is a perspective view of a box assembled from the box blank of FIG. 1.
Figure 1:
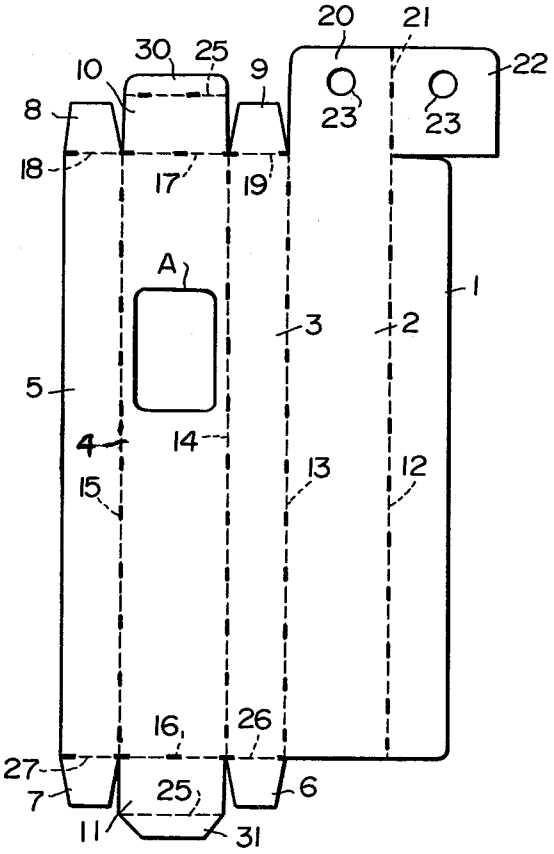
FIG. 1 is a box blank in accordance with the invention.

The invention will now be described in conjunction with some preferred embodiments thereof. Referring now to FIG. 1, there is shown a cut or punched sheet known as a "box blank", which can be assembled into a package box as shown in FIG. 2. It has a display window A through which a packed article may be displayed, and it includes a side flap 1 which is to be bonded in assembling and is integral with front, back and side sections 4, 2, 3, and 5, respectively end flaps 6, 7, 8 and 9 and end sections 10 and 11, these sections and flaps being defined by respectively associated fold or score lines 12, 13, 14, 15, 16, 17, 18, 19, 26 and 27. The back section 2 includes an extension constituting a hanger flap 20, or more precisely first hanger flap, which is integral with a flap 22, or more precisely second hanger flap, defined by an extended fold line 21 of the fold line 12 and positioned so that it can be folded and bonded to the flap 20.

For convenience, the front and back sections 4 and 2 may also be referred to as side sections, such nomenclature being consistent with the practice of terming the box of the present invention a "five-sided" box, the fifth side, of course, being side flap 1. Bonding flap 1 is joined to section 5 to form the usual 4-sided or 4-faced box.

Over the display window A, which may, for instance, be formed at the time of punching the structure of FIG. 1, is applied, if desired, a transparent sheet or film such as vinyl film, polypropyrene film, cellophane film and the like. Also, either the window area alone, or the entire box walls may be provided with an overlying layer of transparent film such as cellophane film or a shrunk film if it is found necessary. Further, it is possible to dispense with the window if a sheet of a transparent or semi-transparent material, for instance a semi-hard synthetic resin sheet, is used as the material of the box.

The first and second hanger flaps 20 and 22 are formed with respective hook holes or openings 23, which are symmetrical with respect to the line 21 so that they are in registry with each other when the flaps are folded and bonded together by an adhesive.

Figure 3:
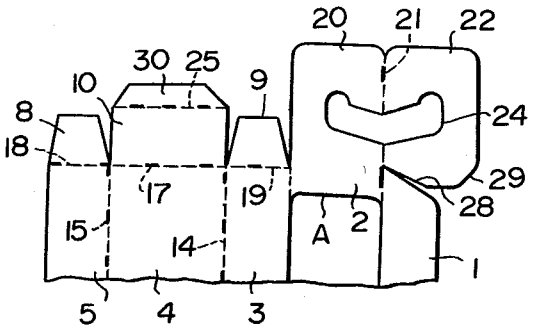
FIGS. 3 and 4 are box blanks showing modifications of the hanger portion of the box blank of FIG. 1.
Figure 4:
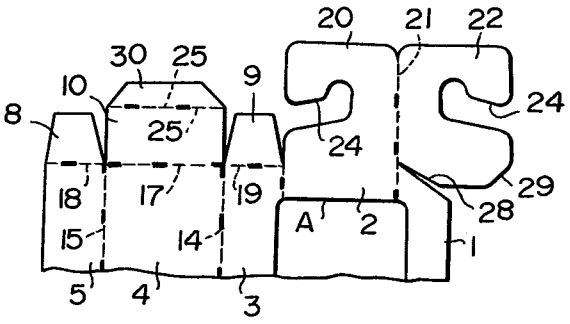

Alternatively, a continuous hook groove 24 symmetrical with respect to the bend line 21 between the flaps 20 and 22 may be formed, as shown in FIG. 3, or symmetrical hook notches 24 symmetrical with respect to the bend line 21 and extending from the opposing edges of the flaps 20 and 22 may be formed, as shown in FIG. 4.

The end sections 10 and 11 are integral with respective marginal flaps 30 and 31 via respective bend lines 25. These marginal flaps may be used as insertion flaps to extend within the box when the box is assembled, or the marginal flap 30 may be used as reinforcement flap bonded to the first or second hanger flaps 20 and 22 or back section 2 so as to reinforce the boundary between the eventual hanger portion and box body portion. Further, in place of providing the marginal flap 31 for the end section 11 which constitutes the bottom of the assembled box, the back section 2 (FIG. 12) opposing front section 4 when assembled may be provided with an extension extending from its end remote from the first hanger flap 20 and identical with the end section 11, so that the extension may be bonded to the end section 11 for reinforcing the bottom.

For further reinforcing an upper portion of the hanger portion, an auxiliary flap 22′ (FIG. 11) may be provided such that it extends from the edge of the first hanger flap 20 on the side thereof opposite the second hanger flap 22, and it may be bonded between the flaps 20 and 22.

Figure 5:
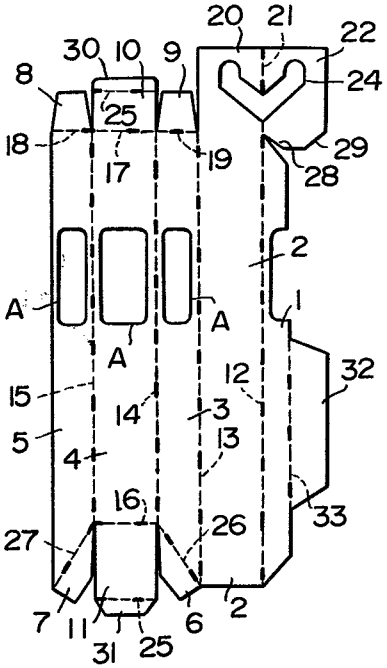
FIG. 5 is another embodiment of a box blank.

Further, it is possible to provide the side flap 1 with a retainer flap 32 (FIG. 5) extending sidewise from the edge of the flap 1 opposite the back section 2, as shown in FIG. 5, which retainer flap may serve to hold the packed article in position within the assembled box. Where additional display windows A in side portions 3 and 5 are provided, this retainer flap 32 preferably lies below the window for the sake of appearance, but of course it is possible to dispose such a retainer flap above the windows, as well as or instead of the flap below the window.

All the fold lines are preferably provided with dash cuts, and this not only provides for sharp and neat corners formed along the individual fold lines when assembling the box but also improves fitness to the use of machines for assembly and hence processing efficiency. In addition, in the case of the package box which is to be discarded after the start of use of the contained article, as exemplified by a tooth brush box, the article can be quickly taken out by easily opening or breaking the box along a dash cut line. Particularly, where the marginal flaps 30 and 31 extending from the end sections 10 and 11 are bonded to the hanger portion and side section 2, with cut dashes provided particularly along the bend lines 25, 12 and 13 the packed article may be very readily taken out by merely pulling the hanger portion firmly.

Figure 6:
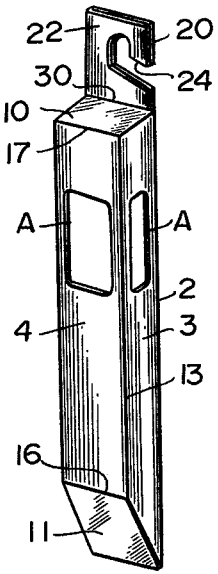
FIG. 6 is a perspective view of the box blank of FIG. 5 in assembled form.

In the example of FIGS. 5 and 6, the bottom of the assembled package box constituted by the end section 11 is not perpendicular to every side but inclined with respect to the back 2 and front 4. To achieve this, the end flaps 6 and 7 are defined by inclined bend lines 26 and 27. In this example, windows A are provided in the side sections 3 and 5 as well as in the front section 4 to provide for added display angles for the contained article.

Figure 7:
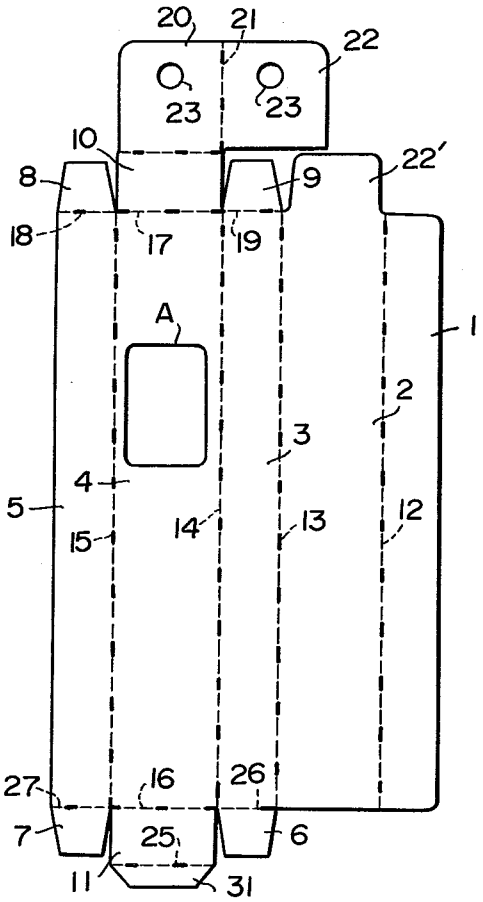
FIGS. 7, 8 and 9 are further embodiments of box blanks.
Figure 9:
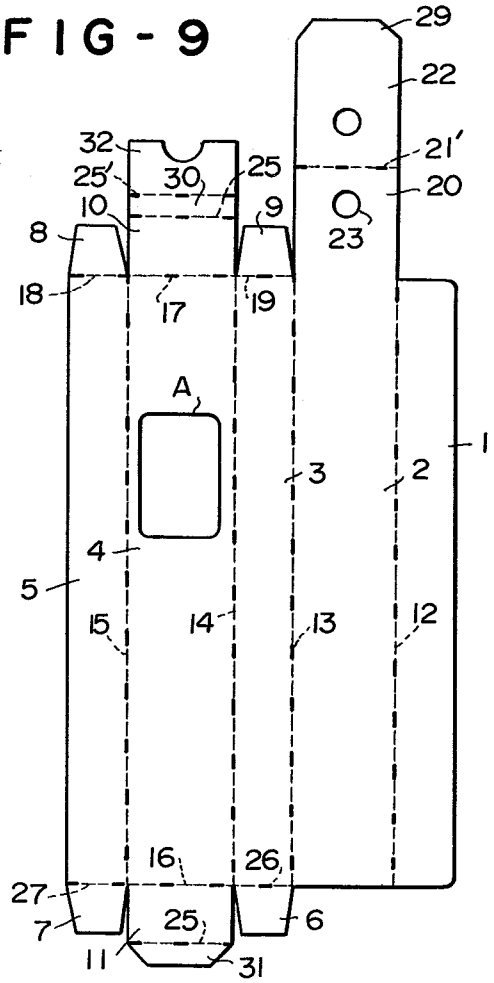
Figure 8:
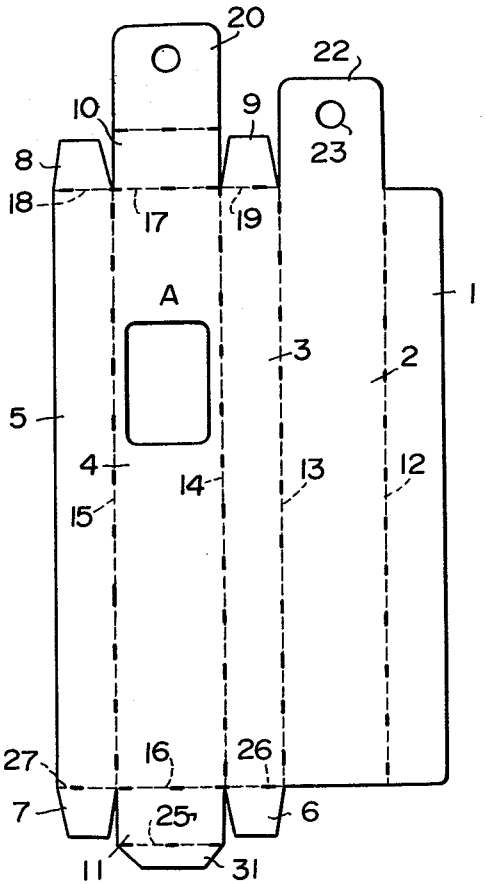

FIGS. 7 to 9 show other examples of the first and second hanger flaps 20 and 22. In the example of FIG. 7, the hanger flaps 20 and 22 are provided on the end section 10 extending from the front section 4, in place of providing them on the back section 2. In addition, an auxiliary flap 22′ extends from back section 2. This auxiliary flap 22′ may be bonded between the hanger flaps 20 and 22 when assembling the box to provide for increased reinforcement of the hanger portion.

In the example of FIG. 8, the first and second hanger flaps 20 and 22 constituting the hanger portion are separately provided on the respective front and back sections 4 and 2. Since in this case the first hanger flap 20 replaces the marginal flap 30 extending from the end section 10 in the case of FIG. 1, the same effects can be achieved with a simpler structure.

Figure 10:
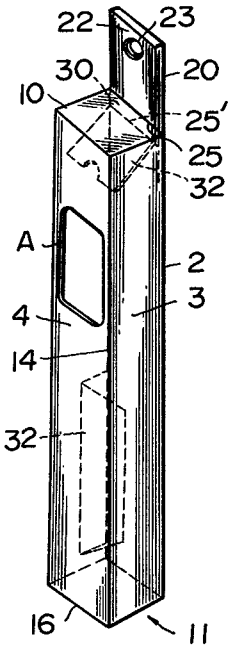
FIG. 10 is a perspective view of the embodiment of FIG. 9 in assembled form.

In the example of FIG. 9, the second hanger flap 22 extends from the first hanger flap 20 in the longitudinal direction thereof via a bend line 21′. In addition, a retainer flap 32 serving to hold the packed article in position is provided to extend from the marginal flap 30. In assembly, the retainer flap 32 is disposed within the box and folded from the marginal flap 30, which is bonded in this case to the back section 2, flap 32 extending towards the face having the display window A, whereby the packed article can be held in correct position within the box. As will be understood from the description so far, it is possible in practice to use the retainer flap 32 shown in FIG. 9 in combination with the retainer flap 32 shown in FIG. 5 and also provide these retainer flaps 32 with appropriate notches in conformity to the kind and contour of the article to be accommodated within the box, whereby the article may be steadily and reliably held in proper position within the box (see FIG. 10). Of course, these retainer flaps 32 may be incorporated in the example of FIG. 1.

In FIGS. 3, 4 and 5, designated at 28 is an inclined cut line, and at 29 (FIG. 9) reinforcing flap extending from the second hanger flap 22 and adapted to be bonded to and reinforce the boundary portion between the hanger portion and the box body portion, that is, a portion extending from the eventual position of the edge of the end section 10 joined to the back section 2 of the box body portion.

Figure 11:
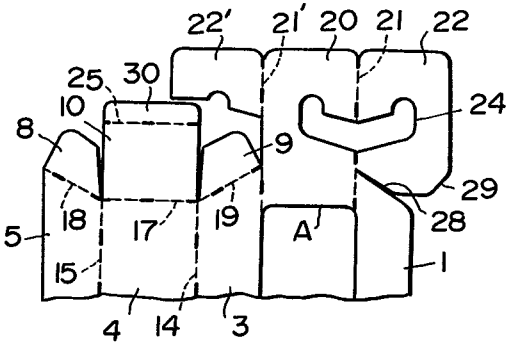
FIG. 11 is a box blank showing a further example of the hanger portion.

In the package boxes of the present invention, it is the boundary portion between the hanger portion and box body portion which is subjected to the greatest stress and therefore must be most strongly reinforced. FIG. 11 shows a modification regarding the reinforcement of the hanger portion. In this case, an auxiliary flap 22' is provided, on one edge of the first hanger flap 20, via a bend line 21. The flap 22' is on the edge of the flap 20 opposite to that joined to the flap 22, and this auxiliary flap is folded and bonded between the flaps 20 and 22 to provide for the reinforcement of the hanger portion, particularly that portion adjacent to the hook notch constituted by the groove 24. The assembled package box of this example is suited to accommodate small articles of heavy weight.

Figure 13:
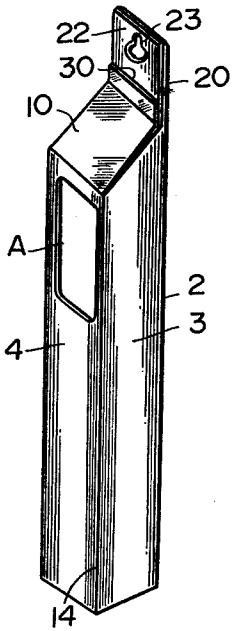
FIG. 13 is a perspective view of the box blank of FIG. 12 in assembled form.
Figure 12:
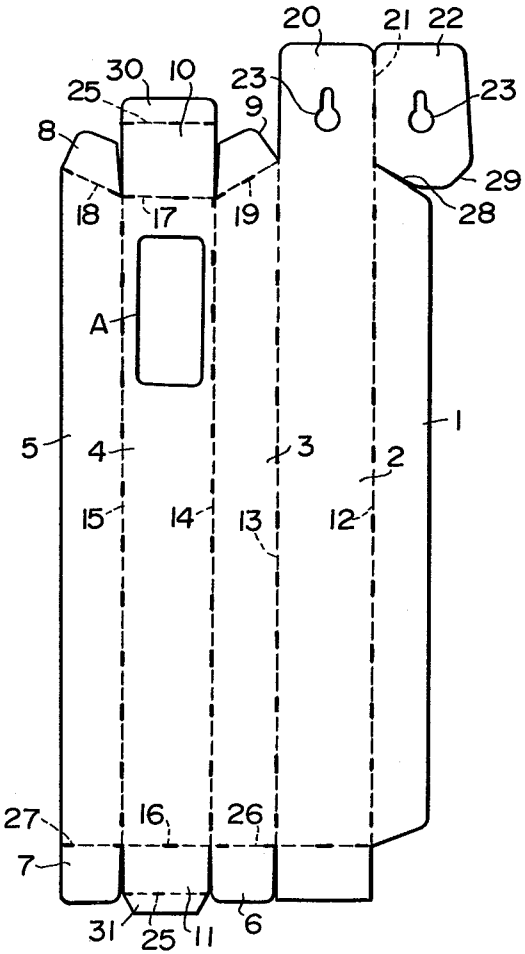
FIG. 12 is a box blank of a still further embodiment.

In the embodiments of FIGS. 12 and 13, at least one of the end sections 10 and 11, in this case the top end section 10, is inclined with respect to the faces 2 and 4. This is achieved by arranging that the bend lines 18 and 19 defining the end flaps 8 and 9, extending from the opposite ends of a bend line 17, are inclined with respect to the bend lines 14 and 15, making an obtuse angle therewith. With this structure, the step of folding the second hanger flap 22 and bonding it to the first hanger flap 20 may be carried out after the steps of forming the basic box structure by bonding the side flap 1 to the side section 5. Also, the inner side of the assembled box, or more particularly a root portion of the first hanger flap 20, may be reinforced with the reinforcing flap 29. Further, the inclined top end may have an effect of exerting pressure on the article accommodated within the box so as to keep the article in position.

Figure 15:
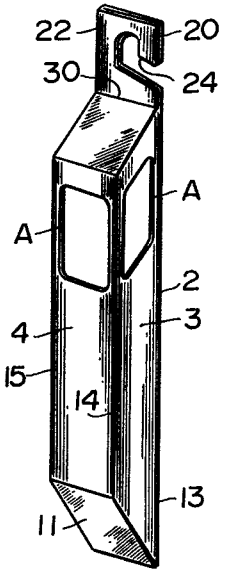
FIG. 15 is a perspective view of the box blank of FIG. 14 in the assembled state.
Figure 14:
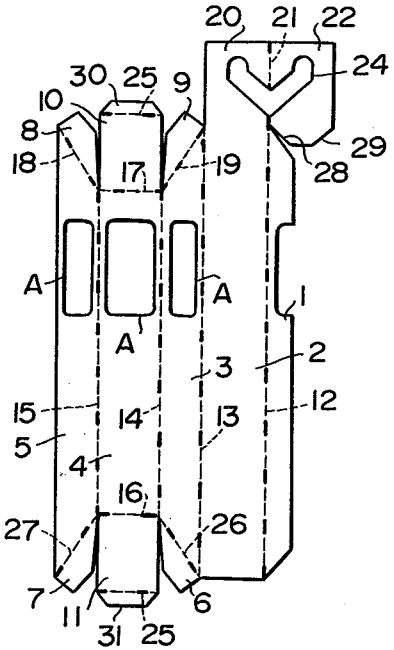
FIG. 14 is a box blank of a yet further embodiment.

FIGS. 14 and 15 show a further embodiment, in which the end section 11 constituting the bottom of the box, as well as the end section 10, is inclined when assembled. Such an arrangement is also shown in the box of FIG. 6, assembled from the cut-out of FIG. 5.

While specific examples of the invention have been described in conjunction with FIGS. 1 to 15, various changes and modifications in the design are possible without departing from the scope of the invention. For example, the edges of the hanger flaps 20 and 22 constituting the top edge of the hanger section may be curved in a desired fashion or formed into a hill-like or wavy shape or various other shapes to provide for added design effect in combination with the hook hole or hook notch. Also, the display window A need not be rectangular but may have a flower-like shape or various other shapes. Further, it is possible to provide two or more windows. Furthermore, these windows may be provided at desired positions other than those shown. For example, some windows may extend over adjacent two sides provided they are so shaped that they do not decrease the strength of the box excessively.

Moreover, as for the material of the box according to the invention, it is of course possible to select a suitable material from a wide variety of materials such as paper sheets, cardboard sheets, semi-hard synthetic resin sheets, paper sheets laminated with aluminum foil and so forth, in accordance with the desired display effect, printing effect and the like.

In general assembly, the eventual box sheet is first bent along the bend lines 12, 13, 14 and 15 defining the side sections 2, 3, 4 and 5, bent along the line 21 defining the first and second hanger flaps 20 and 22, and then the top and bottom end sections 10 and 11 and end flaps 6, 7, 8 and 9 are laid one above another in suitable order, whereby assembled package boxes as shown in FIGS. 2, 6, 10, 13 and 15, capable of accommodating small commodities such as a tooth brush, are obtained.

As has been described in the foregoing, the assembled package box according to the invention, for accommodating small articles for display, has a structure including a hanger portion for the purpose of support, the hanger portion being formed by lapping and bonding together two flaps of substantially identical shape, and it is very useful in that it permits manufacture with minimum waste of material, permits the bonding of the box body and the folding and bonding of the hanger portion to be automatically carried out in a single step with an automatic apparatus and further permits efficient packing operation with a conventional cartoning machine. In addition, the hanger portion can be effectively reinforced without sacrifice in the operability of machines in packing as well as in manufacture. Further, mass production and cost reduction can be achieved. Furthermore, it is possible to provide the box according to the invention as a consumable item to be discarded after use without feeling any sense of departure from economy and also without giving rise to any disposal problem after discarding.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A box blank for assembly into a package box for display including:

a side flap to be bonded for forming a basic box structure;

a back, a front and two side sections integral with said side flap and defined by respective parallel sectioning scored lines for folding therearound in the assembly of said package box, said back, front and two side sections constituting the sides of said box;

top and bottom end sections each extending from said front section and individually defined by respective sectioning lines between said end sections and said front section, said end sections constituting the top and bottom of the box respectively, said top end section having a marginal flap defined by an end sectioning line between said top end section and said marginal flap;

a hanger portion for forming a hanger above said basic box structure, said hanger portion comprising a first hanger portion flap extending from said back section, said first hanger portion and back section being free of sectioning lines therebetween; and a second hanger portion flap having a shape substantially conforming to the shape of said first flap and extending from a portion of said first hanger portion flap, and positioned adjacent to said side flap and defined by an extended substantially straight sectioning line defining said back section from said side flap and shaped so that it may be brought into registry with said first hanger portion flap;

at least said sectioning lines defining said back section and said end sectioning line defining said top end section marginal flap being formed with dash cuts;

said hanger portion being apertured for convenience in hanging said package box therefrom, said package box comprising a basic box structure for holding a packaged item and a hanger portion above said basic box structure, said hanger portion being reinforced by the presence of at least two layers of sheet therein, whereby said packaged box assembled from said box blank may be opened by holding said box and pulling away on said hanger portion to rip the section lines weakened by said dash cuts.

2. The box blank according to claim 1, wherein said box blank further includes end flaps extending from both ends of both side sections, each end flap being defined by a score line between each end flap and the corresponding side section, two of said end flaps constituting a first pair for forming said top end portion and the other two end flaps constituting a second pair for forming said bottom end portion.

3. The box blank according to claim 2, wherein at least one of said pairs of end flaps is defined by respective sectioning lines inclined at an angle other than 90° with respect to the sectioning lines defining said side sections.

4. The assembled package box for display according to claim 3, wherein said box blank further includes an auxiliary flap extending from said first hanger portion flap and defined by a score line therebetween.

5. The box blank according to claim 1, wherein said front section is provided with a window.

6. The box blank according to claim 5, wherein said window is provided with a transparent film applied over it.

7. The assembled package box for display according to claim 1, wherein said box blank further includes a retainer flap for holding an accommodated article in position.

8. The box blank according to claim 1, wherein at least one of said side sections is provided with a window.

9. The box blank according to claim 1, wherein said box blank further includes a marginal flap extending from said end section and joined with said hanger portion, thereby serving to reinforce said hanger portion.

10. The blank according to claim 1, wherein said back section of said blanks extends longitudinally beyond said front sections so that at least one of said end sections makes an angle other than 90° with said front section when said blank is assembled into a box.

11. The box blank according to claim 1, wherein said side flap is formed with a vertically extending retainer flap integral with said side flap for holding an article within said package box.

12. The blank according to claim 1, wherein said blank further comprises end flaps joined to the ends of said side sections and marginal flaps joined to the ends of said end sections for reinforcing the ends of an assembled box.

13. The box blank as defined in claim 1, wherein said blank comprises a sheet material selected from the group consisting of paper, cardboard, semi-hard synthetic resin, and paper laminated to aluminum foil.

14. The box blank of claim 1, wherein a third reinforcing hanger flap extends from the opposite side of said first hanger portion flap and serves to reinforce the hanger portion.

15. A package box consisting of a basic box structure and a hanger portion, said box assembleable from a box blank comprising:

a side flap;

a back, a first side, a front and a second side section respectively integral with said side flap and defined by respective parallel sectioning scored lines for folding therearound in the assembly of said package box, said back, front and two side sections constituting the sides of said basic box structure;

top and bottom end sections each extending from said front section and individually defined by respective sectioning lines perpendicular to said first-mentioned sectioning lines, said end sections constituting the top and bottom of said box structure, respectively, each of said top and bottom end sections having a marginal flap defined by an end sectioning scored line between said marginal flap and said end section;

at least said sectioning scored lines defining said back section from said side flap and said first side and said end sectioning scored lines defining said marginal flaps being provided with dash cuts;

end flaps extending from both ends of both side sections, each end flap being defined by a sectioning scored line between each end flap and the corresponding side section, two of said end flaps constituting a first pair for forming the top end portion and the other two end flaps constituting a second pair for forming the bottom end portion of said box, said first pair of end flaps defined by respective sectioning lines being inclined at an angle other than 90° with respect to the sectioning lines defining said side sections;

a hanger portion for forming a hanger above said basic box structure, said hanger portion comprising a first hanger portion flap extending from said back section, said first hanger portion and said back section being free of sectioning lines therebetween;

a second hanger portion flap having a shape substantially conforming to the shape of said first flap and extending from a portion of said first hanger portion flap and positioned adjacent to said side flap and defined by an extended substantially straight sectioning line defining said back section from said side flap and brought into registry with said first hanger portion flap; and said hanger portion being apertured for convenience in hanging said package box therefrom, said package box comprising a basic box structure for holding a packaged item and a hanger portion above said basic box structure, said hanger portion being reinforced by the presence of at least two layers of sheet therein, whereby said package box may be opened by holding said box structure and pulling away on said hanger portion to rip said sectioning lines weakened by said dash cuts.

16. The box according to claim 15, wherein said front section and said side sections each have a window therein.

17. The box of claim 15, wherein said front section is provided with a window.

18. The box according to claim 14 wherein said side flap being bonded to said second side and said marginal flaps being bonded to said back section of said package box.

* * * * *